US008893945B2

(12) United States Patent
Zhou

(10) Patent No.: US 8,893,945 B2
(45) Date of Patent: Nov. 25, 2014

(54) ELECTRIC HAMMER

(75) Inventor: Hongtao Zhou, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 644 days.

(21) Appl. No.: 13/179,815

(22) Filed: Jul. 11, 2011

(65) Prior Publication Data

US 2012/0006879 A1 Jan. 12, 2012

(30) Foreign Application Priority Data

Jul. 12, 2010 (CN) ..... 2010 2 0257029 U

(51) Int. Cl.
*B25C 1/06* (2006.01)

(52) U.S. Cl.
CPC ..... *B25C 1/06* (2013.01)
USPC ..... 227/147; 227/119; 227/140; 81/434; 81/463; 279/71; 279/81

(58) Field of Classification Search
USPC ..... 227/147, 149, 119, 140, 129, 131; 279/71, 74, 81, 82; 269/229, 236, 3, 6; 81/44, 454, 455, 463, 434, 464, 469
See application file for complete search history.

(56) References Cited

U.S. PATENT DOCUMENTS

| | | | | | |
|---|---|---|---|---|---|
| 870,142 | A * | 11/1907 | Wahlstrom | 279/69 |
| 2,027,486 | A * | 1/1936 | Lapointe | 279/74 |
| 3,219,074 | A * | 11/1965 | Rohm | 81/455 |
| 3,965,950 | A * | 6/1976 | MacDonald | 81/455 |
| 4,237,946 | A * | 12/1980 | Leitner | 81/429 |
| 4,434,859 | A * | 3/1984 | Rumpp et al. | 173/48 |
| 4,594,036 | A * | 6/1986 | Hogenhout | 408/240 |
| 5,013,194 | A * | 5/1991 | Wienhold | 408/240 |
| 5,341,708 | A * | 8/1994 | Nick | 81/451 |
| 5,573,255 | A * | 11/1996 | Salpaka | 279/75 |
| 6,155,145 | A * | 12/2000 | Oh et al. | 81/451 |
| 6,676,001 | B1 * | 1/2004 | Chen et al. | 227/119 |
| 6,834,864 | B2 * | 12/2004 | Girardeau | 279/60 |
| 6,851,194 | B1 * | 2/2005 | Chen et al. | 30/392 |
| 7,017,790 | B1 * | 3/2006 | Peng | 227/119 |
| 7,160,065 | B2 * | 1/2007 | Huggins et al. | 408/240 |
| 7,234,376 | B2 * | 6/2007 | Bader | 81/55 |
| 7,661,340 | B2 * | 2/2010 | Xu | 81/434 |
| 7,665,216 | B2 * | 2/2010 | Yasheng | 30/392 |
| 8,308,039 | B2 * | 11/2012 | Wei | 227/147 |
| 8,424,734 | B2 * | 4/2013 | Zhou | 227/147 |
| 8,469,250 | B2 * | 6/2013 | Zhou | 227/147 |
| 8,596,512 | B2 * | 12/2013 | Zhou et al. | 227/147 |
| 2008/0054043 | A1 * | 3/2008 | Beales | 227/129 |

* cited by examiner

*Primary Examiner* — Scott A. Smith
(74) *Attorney, Agent, or Firm* — Greenberg Traurig, LLP

(57) ABSTRACT

An electric hammer has a housing having a nozzle portion, a motor and a transmission mechanism arranged in the housing, a striking device, coupled to the motor and transmission mechanism, for moving in a reciprocating manner in the nozzle portion, and a clamping device mounted to the nozzle portion and at least partially extending out of the nozzle portion. The clamping device includes an outer sleeve, an inner sleeve arranged in the outer sleeve, and at least two clamping members arranged on the inner sleeve. The inner sleeve has a first position and a second position with respect to the outer sleeve and the distance between the two clamping members in the first position is less than the distance between the two clamping members in the second position to thereby allow a nail to be released halfway, i.e., when partially struck into a workpiece, in a simple manner.

6 Claims, 5 Drawing Sheets

ELECTRIC HAMMER

RELATED APPLICATION DATA

This application claims the benefit of CN 201020257029.5, filed on Jul. 12, 2010, which application is incorporated herein by reference in its entirety.

BACKGROUND

The following generally relates to electric tools and, more particularly, to an electric tool with a clamping mechanism for striking nails or other similar fasteners, which is also called as an electric hammer.

Electric hammers are used in the decoration and renovation fields. An electric hammer generally includes a housing with a nozzle portion; a motor and a transmission mechanism arranged in the housing; a striking device with a striking shaft passing through the nozzle portion; and a clamping device mounted in the nozzle portion. The clamping device may firmly clamp a stem portion of a nail during striking of the nail, thus the user need not worry that the nail may be struck while in a slated orientation. Presently known clamping devices cannot, however, automatically release the nail halfway, that is to say, the clamping device releases the nail only when the nail is completely struck into the workpiece. If a nail needs to be released from the clamping device halfway during a striking of the nail, the clamping device must be manually moved to a releasing position, or some members such as toggling or lever members need to be provided for moving the clamping device to the releasing position, which results in that a device that is overly complex to operate and complex in construction. As the electric hammer is used more and more in various occasions in the decoration industry, for example, when some decorations need to be mounted on the wall, these decorations often need to be hung on a nail which is partly struck into the wall, presently known electric hammers cannot be conveniently used in these occasions because they cannot release the nail halfway automatically.

SUMMARY

To overcome this and other problems, the subject electric hammer is provided with a clamping device which may firmly clamp a nail and automatically release the nail halfway.

More particularly, the subject electric hammer includes a housing having a nozzle portion, a motor and a transmission mechanism arranged in the housing, a striking device moving in a reciprocating manner in the nozzle portion, and a clamping device mounted in the nozzle portion and extending out of the nozzle portion, wherein the clamping device includes an outer sleeve, an inner sleeve arranged in the outer sleeve and at least two clamping members arranged on the inner sleeve, the inner sleeve having a first position and a second position with respect to the outer sleeve, and the distance between the two clamping members in the first position is less than that between the two clamping members in the second position.

With the above electric hammer, it will be easy for the user to release the nail halfway, i.e., when partially struck into a workpiece. When a nail needs to be released from the clamping device, the electric hammer may be pulled in a direction contrary to the direction along which the nail would be struck into the workpiece. Because the clamping device is mounted to the nozzle portion of the electric hammer and extends outwardly therefrom, the outer sleeve of the clamping device protrudes outwards with respect to the nozzle and reaches its maximal protruding position at which the outer sleeve remains stationary with respect to the nozzle when the user pulls the electric nailer with respect to the nail to be struck. In this position, the clamped nail can be moved from the clamped position, where the stem portion of the nail is clamped between the clamping members, to the released position, where a head or cap of the nail can pass through a space between the clamping members along with the movement of the inner sleeve from the first position to the second position. The releasing process of the nail is thus made simple and the nail may be released without moving the clamping device manually.

DETAILED DESCRIPTION

Preferred embodiments of the subject electric hammer will now be further explained with reference to the accompanying drawings.

Figure 1:
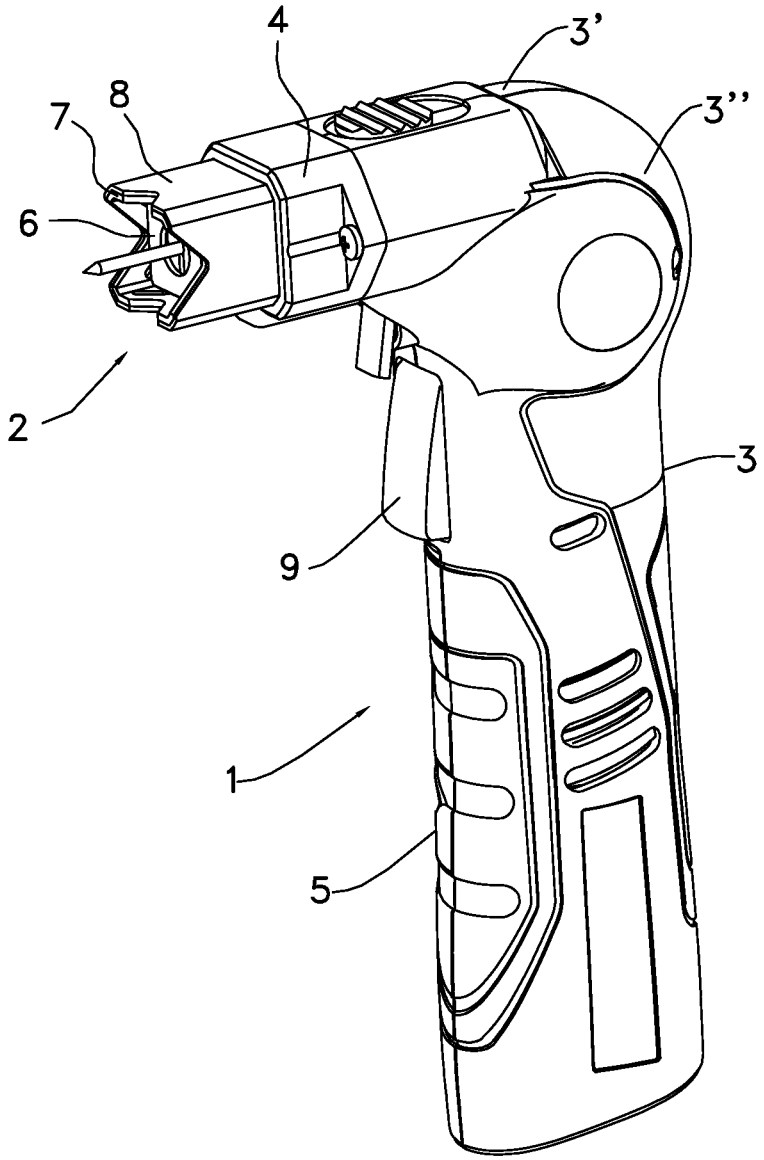
FIG. 1 is a schematic view of an exemplary electric hammer constructed according to the description that follows.

As shown in FIG. 1, an electric hammer 1 according to the present invention includes a housing 3 formed by two half housings 3' and 3" which are mated together. The housing 3 includes a nozzle portion 4 and a gripping handle 5 that are preferably substantially perpendicular with respect to each other. The electric hammer 1 comprises an on-off switch 9 mounted to the gripping handle 5. A clamping device 2, which includes an outer sleeve 7, which may move retractably, and an inner sleeve 6, which is mounted into the outer sleeve 7, is mounted to the nozzle portion 4. Further, the outer sleeve 7 is provided with a casing 8 over the exterior thereof.

Figure 2:
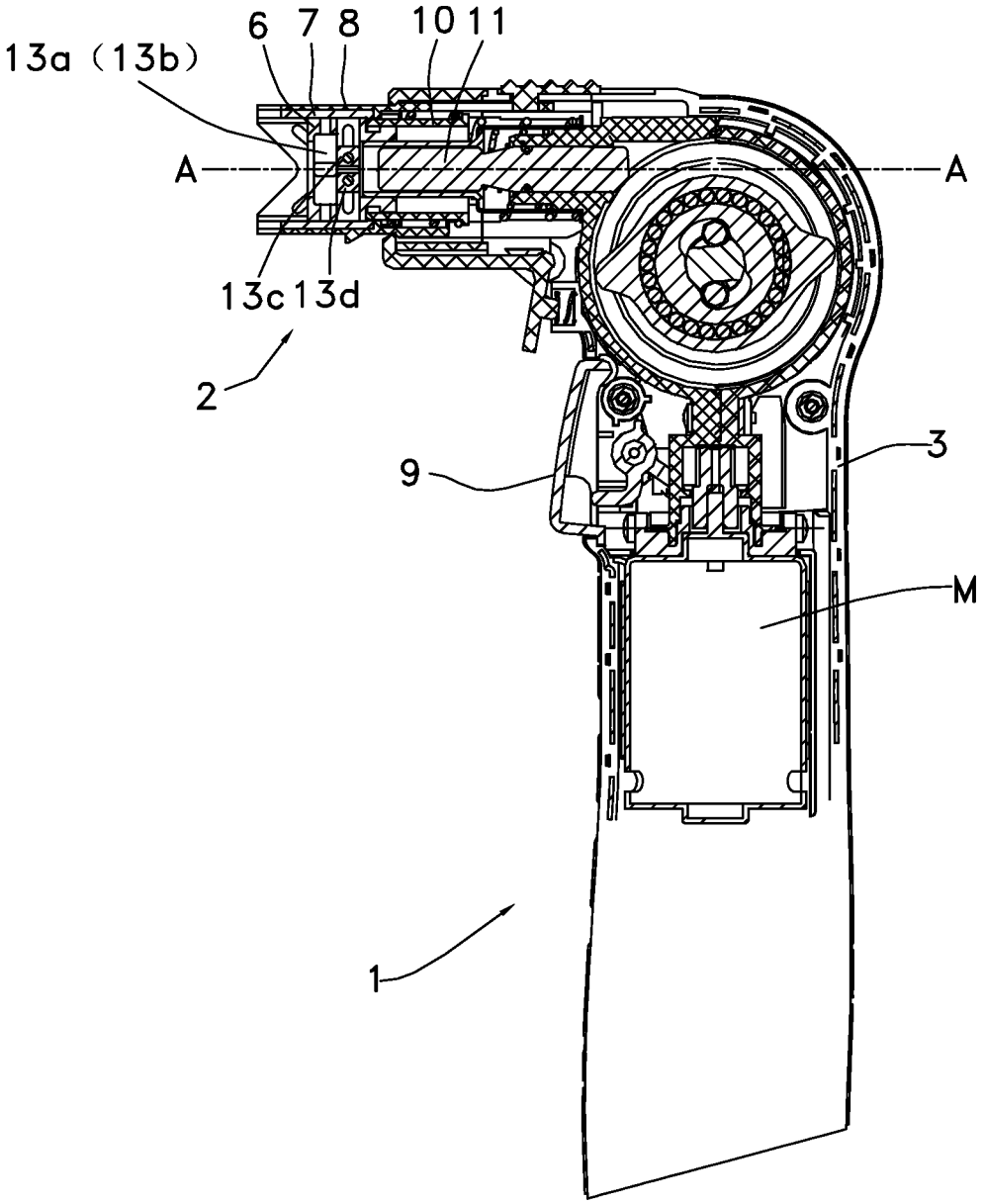
FIG. 2 is a schematic view showing the inner structures of the electric hammer.

As shown in FIG. 2, the housing 3 of the electric hammer is provided with a motor M therein. The motor M may drive a striking device by a transmission mechanism, and the striking shaft 11 of the striking device moves in a linear reciprocating manner in the nozzle portion 4 to impart a striking force on a member to be struck, such as a nail. In the process of striking a member, the member to be struck is clamped between the clamping members 13*a*, 13*b*, 13*c* and 13*d*. The clamping members (13*a*, 13*b*), (13*c*, 13*d*) are symmetrically arranged in pairs on two sides of the axis A-A of the striking shaft 11.

Figure 3:
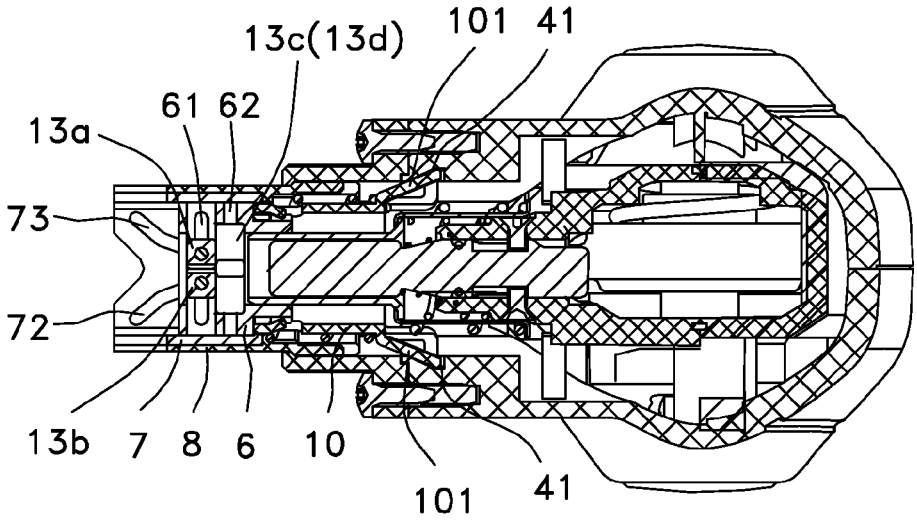
FIG. 3 is a sectional view of a first exemplary arrangement of components of the electric hammer taken along line A-A of FIG. 2.
Figure 4:
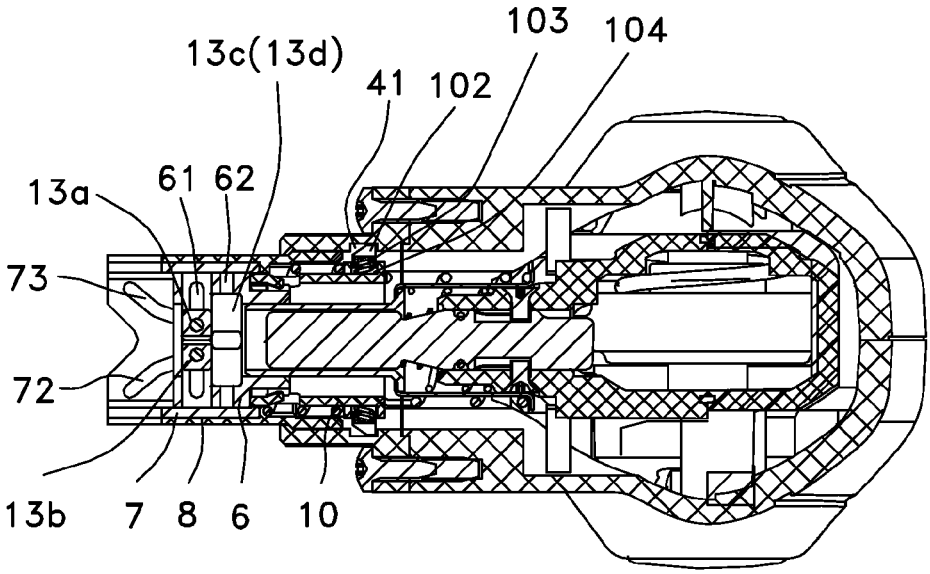
FIG. 4 is a sectional view of a further exemplary arrangement of components of the electric hammer taken along line A-A of FIG. 2.

Referring to FIGS. 3 to 6, the outer sleeve 7 has an approximately square cross-section. A pair of inclined grooves 72, 73, e.g., inclined at an angle with respect to the axis A-A, are arranged on each of the four walls of the outer sleeve 7. The inclining grooves 72, 73 are symmetrically provided at the two sides of the axis A-A. The inner sleeve 6 is provided with a straight groove 61 or 62 that is oriented vertical to the axis A-A on each wall of the inner sleeve 6. The clamping portion of each clamping member is positioned in the inner sleeve 6, and the ends 131*c*, 131*d* of each clamping member are fitted into one straight groove and one inclining groove simultaneously. The rear end of the inner sleeve 6 is fixedly connected with a plastic connecting member 10 which has a rear end as a movable connecting portion. In a preferred embodiment as shown in FIG. 3, the movable connecting portion is an elastic warped piece 101 which directly extends out of the rear end of the connecting member 10 and engaged to the inside of the clamping groove 41 arranged in the housing. In the embodiment as shown in FIG. 4, the movable connecting portion may include a sliding groove 104 arranged in the rear end of the connecting member 10, a spring 103 arranged in the sliding groove, and a sliding block 102 arranged on the spring 103 and sliding in the sliding groove 104. The sliding block 102 may be engaged to the inside of the clamping groove 41 of the nozzle portion 4 and partly protrudes out of the top end of the sliding groove 104. At the side adjacent to the inner sleeve 6, the clamping groove 41 and the sliding block 102 have inclining surfaces mated with each other. It will be appreciated that the connecting member 10 is elastically engaged to the inside of the nozzle portion 4 by the movable connecting portion, thus the movable connecting portion may slide out of the clamping groove 41 when a pulling force from the inner sleeve 6 is exerted on the connecting member 10.

Figure 5:
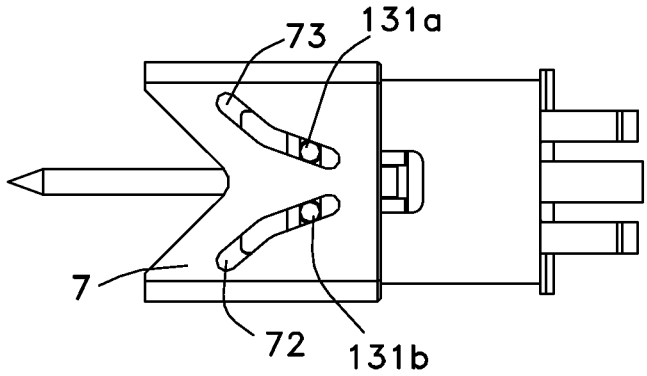
FIG. 5 is a schematic view showing an exemplary clamping device of the electric hammer, wherein an inner sleeve is in the first position.
Figure 6:
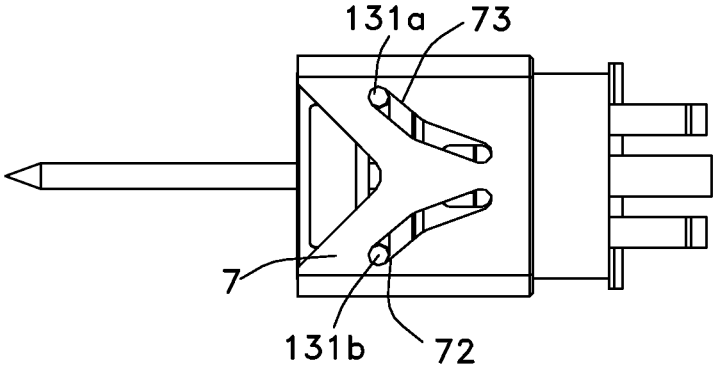
FIG. 6 is a schematic view showing the structure of the clamping device of the electric hammer, wherein the inner sleeve is in the second position.
Figure 7:
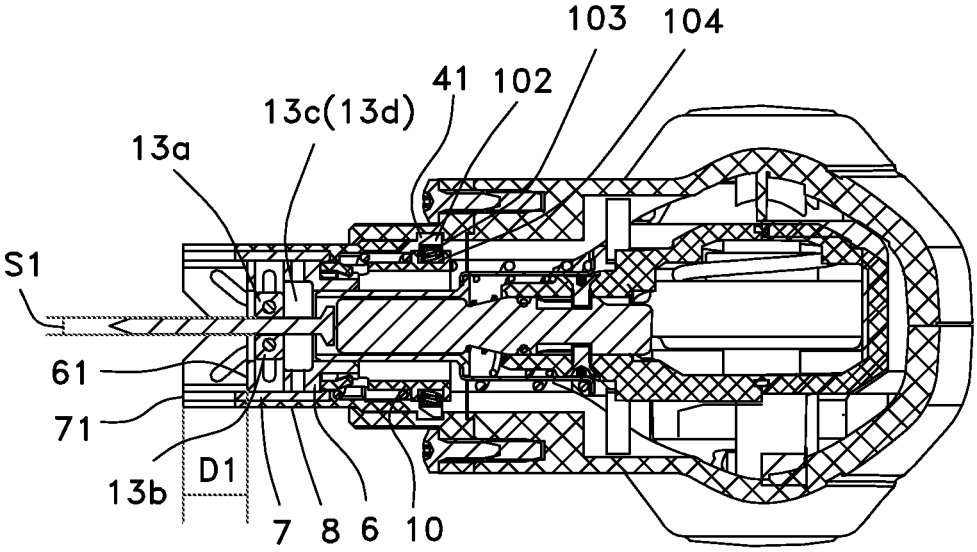
FIG. 7 is a cutaway view showing a state of the electric hammer for releasing the nail halfway, wherein the outer sleeve is in a maximal protruding position out of the nozzle portion, and the inner sleeve is in the first position.
Figure 8:
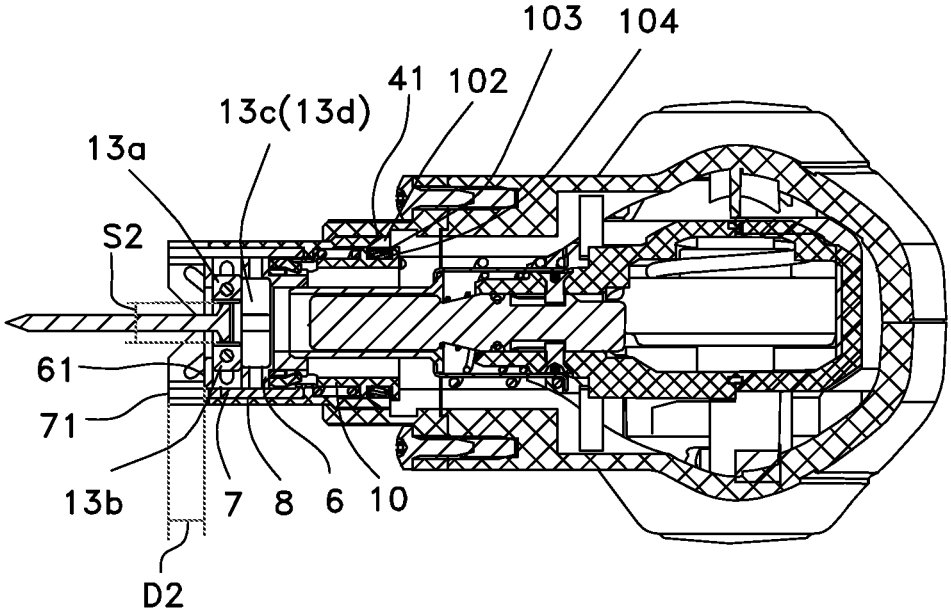
FIG. 8 is a cutaway view showing the state of the electric hammer for releasing the nail halfway, wherein the outer sleeve is in the maximal protruding position out of the nozzle portion, and the inner sleeve is in the second position.

FIGS. 5 to 8 illustrate the process for releasing the nail halfway with the electric hammer according to the described embodiments. FIGS. 5 and 7 show a stem portion of a nail is clamped between the clamping members. At this time, the distance between the front end surface 61 of the inner sleeve 6 and the front end surface 71 of the outer sleeve 7 is defined as D1, the ends 131*a*, 131*b* of the clamping members are positioned in the inclining grooves 73, 72 adjacent to the rear ends of the inclining grooves 73, 72, and the distance between the clamping members 13*a* and 13*b* is equal to a diameter S1 of the stem portion of the nail. FIGS. 6 and 8 show the occasion where the head or cap of the nail is positioned between the clamping members. At this time, the distance between the front end surface 61 of the inner sleeve 6 and the front end surface 71 of the outer sleeve 7 is D2, the ends 131*a*, 131*b* of the clamping members are positioned in the inclining grooves 73, 72 adjacent to the front ends of the inclining grooves 73, 72, and the distance between the clamping members 13*a* and 13*b* is equal to a diameter S2 of the nail head or cap. As illustrated, the position relation between the clamping members 13*c* and 13*d* is consistent with that between the clamping members 13*a* and 13*b* (not shown).

The principle of releasing the nail automatically is as follows: when the nail needs to be released from the clamping device halfway, the used can directly pull the electric hammer in a direction contrary to the direction that the nail would be struck into the workpiece, i.e., in a direction away from the workpiece. Under the action of the elastic biasing device arranged in the nozzle, the outer sleeve of the clamping device protrudes out of the nozzle and reaches its maximal protruding position and remains stationary thereon. At this position, when the nail is in a clamped state, the inner sleeve is at the first position, and the clamping members clamp the stem portion of the nail. As the electric hammer continues to be pulled, the movable connecting portion of the connecting member fixedly connected to the inner sleeve is released from the clamping groove, thus the inner sleeve moves forward with respect to the outer sleeve. When the distance between the front surface of the inner sleeve and the front surface of the outer sleeve is gradually decreased from D1 to D2, the clamping members departs with respect to each other and the distance between the clamping members increases from S1 to S2, and the clamped nail is the released from the clamped position, where the stem portion is positioned between the clamping members, and placed into the released position, where the nail cap is positioned between the clamping members so that the head or cap of the nail can pass through the a space that is now formed between the clamping members. In this manner, the nail, which is struck partially into the workpiece, can be released halfway without the aid of an additional manual operation or an additional releasing mechanism.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalents thereof.

What is claimed is:

1. An electric hammer, comprising:

a housing having a nozzle portion;

a motor and a transmission mechanism arranged in the housing;

a striking device, coupled to the motor and the transmission mechanism, arranged to move in a reciprocating manner in the nozzle portion; and a clamping device mounted to the nozzle portion and at least partially extending out of the nozzle portion, wherein the clamping device includes an outer sleeve, an inner sleeve arranged in the outer sleeve, and at least two clamping members arranged on the inner sleeve, wherein the inner sleeve has a first position and a second position with respect to the outer sleeve, and the distance between the two clamping members in the first position is less than that between the two clamping members in the second position and wherein the clamping device further comprises a connecting member with one end fixedly connected to the inner sleeve and the other end having a movable connecting portion which is connected to the housing.

2. The electric hammer according to claim 1, wherein the distance between the front end surface of the inner sleeve and the front end surface of the outer sleeve in the first position is larger than the distance between the front end surface of the inner sleeve and the front end surface of the outer sleeve in the second position.

3. The electric hammer according to claim 1, wherein a clamping groove is formed in the housing and the movable connecting portion is an elastic warped piece which is engaged into the clamping groove.

4. The electric hammer according to claim 1, wherein a clamping groove is formed in the housing and the movable connecting portion includes a sliding groove with a spring arranged therein and a wedge block arranged on the spring engaged into the clamping groove and partially extending out of the top end of the sliding groove.

5. The electric hammer according to claim 1, wherein the outer sleeve is provided with inclining grooves inclined with respect to an axis of the striking device and wherein the clamping members are connected into the inclining grooves.

6. The electric hammer according to claim 5, wherein the inner sleeve is provided with straight grooves vertical to the axis of the striking device and wherein the clamping members are connected into the inclining grooves and the straight grooves simultaneously.

* * * * *